United States Patent [19]

Ogawa et al.

[11] Patent Number: 4,508,818

[45] Date of Patent: Apr. 2, 1985

[54] SILVER HALIDE PHOTOGRAPHIC SENSITIVE MATERIALS

[75] Inventors: Masashi Ogawa; Kunio Ishigaki; Nobuyuki Iwasaki; Taku Nakamura, all of Kanagawa, Japan

[73] Assignee: Fuji Photo Film Co., Ltd., Kanagawa, Japan

[21] Appl. No.: 592,763

[22] Filed: Mar. 26, 1984

Related U.S. Application Data

[63] Continuation of Ser. No. 391,663, Jun. 24, 1982, abandoned.

[30] Foreign Application Priority Data

Jun. 24, 1981 [JP] Japan ..... 56-97998

[51] Int. Cl.[3] ..... G03C 1/76; G03C 1/30

[52] U.S. Cl. ..... 430/523; 430/539; 430/621; 430/622; 430/961

[58] Field of Search ..... 430/539, 961, 621–626

[56] References Cited

U.S. PATENT DOCUMENTS 2,481,476 9/1949 Murray ..... 430/621
4,161,407 7/1979 Campbell ..... 430/621
4,267,265 5/1981 Sugimoto et al. ..... 430/961
4,304,852 12/1981 Sugimoto et al. ..... 430/961

FOREIGN PATENT DOCUMENTS 2064800 5/1974 United Kingdom .
1534455 12/1978 United Kingdom .

*Primary Examiner*—Mary F. Downey
*Attorney, Agent, or Firm*—Sughrue, Mion, Zinn, Macpeak, and Seas

[57] ABSTRACT

A silver halide photographic sensitive material is disclosed. The material is comprised of a support base which has a sensitive silver halide emulsion layer on the surface of the base. On the silver halide emulsion layer is a first and a second insensitive layer. The second insensitive layer has a melting time which is higher than that of the first insensitive layer. The first insensitive layer has a melting time which is equal to or higher than the melting time of the silver halide emulsion layer. The resulting material can be advantageously utilize within an automatic developing apparatus. The material has improved mechanical properties and results in a reduced amount of scum being formed within the developing solution.

23 Claims, No Drawings

SILVER HALIDE PHOTOGRAPHIC SENSITIVE MATERIALS

This application is a continuation of application Ser. No. 391,663, filed June 24, 1982 now abandoned.

BACKGROUND OF THE INVENTION

The present invention relates to silver halide photographic sensitive materials and, particularly, to silver halide photographic sensitive materials having an improved covering power which cause a remarkably lower degree of reticulation and can reduce the amount of scum formed in the developing solution.

Generally, in order to shorten developing time of sensitive materials the developing temperature is gradually increased to about 27° C. or more. The shorter developing time can be obtained by using an automatic developing apparatus capable of carrying out rapid development with good reproduction as described in U.S. Pat. Nos. 3,025,779 and 3,672,288, and *Rodal Technol.* 44 No. 4 257–261 (1973). The automatic developing apparatus generally includes a developing bath, a stopping bath, a fixing bath, a water wash bath and a drying zone. The conveying rate of films and processing temperature can be controlled within the apparatus.

Farnell et al (*J. Phot. Sci.,* vol. 18 page 94 (1970)) discloses that the covering power of photographic sensitive materials using silver halide emulsions can be improved by varying the degree of hardening of the gelatine binder in order to vary the degree of swelling in the processing solution. It has been noted that the covering power increases with a decrease of the degree of hardening of the silver halide sensitive layer by reducing the amount of a hardening agent. However, if the degree of hardening is extremely low, the strength of the emulsion layer deteriorates remarkably. Accordingly, when processed with the above described automatic developing apparatus, the silver halide emulsion layer is easily separated from the base and/or the emulsion layer is easily scratched by handling during the processing. Further, as another problem, the binder which may come out of the sensitive material, alone or by bonding to other components in the processing solution and/or the sensitive material, sometimes forms insoluble sediments in the processing solution in the automatic developing apparatus. Such insoluble sediments in the processing solution are generally referred to as "scum" in this field. When the scum is formed in the processing solution, it adheres to the sensitive material passing through the automatic developing apparatus resulting in a considerable amount of pollution. The scum adhering to the sensitive material causes remarkable deterioration of the quantity of images on the sensitive material, by which the commercial value is lost entirely.

Further, if high temperature rapid treatment is carried out, the photographic sensitive emulsion layer and other layers swell and soften excessively and this causes physical strength to deteriorate and frequently causes the formation of network patterns called reticulation on the surface.

Accordingly, the degree of hardening of the silver halide emulsion layer must be increased to some degree in order to improve the above described problems. However, as the degree of hardening is increased the covering power descreases. Although there are many known methods of hardening the silver halide emulsion layer, none of them overcome the above described contrary relationship.

As a result of studies relating to improving such problems, it is found that the drawbacks caused by scum can be substantially eliminated if the hardness of the insensitive upmost layer (hereinafter, referred to as "upmost layer") is increased utilizing a hardening technique capable of controlling the hardness of the upmost layer and that of the silver halide emulsion layer, separately.

When dealing with multilayer coating materials, if the upmost layer is hardened so as to have a hardness higher than that of the lower layer, network patterns called "reticulation" occur. Accordingly, there is deterioration of the covering power according to the degree of reticulation when carried out a high temperature treatment. (edited by R. J. Cox; Tojos. Photographic Gelatin, pages 49–61, (1972), Academic Press).

A method for preventing the occurrence of reticulation involves adding carboxymethyl casein or sodium ethyl cellulose sulfate to the uppermost layer as described in (U.S. Pat. No. 887,012), or adding a carboxyl group containing polymer as described in (Japanese Patent Application (OPI) No. 36021/77) or adding acid-treated gelatine as described in (Japanese Patent Application (OPI) No. 6017/76). However, these methods are not always suitable, because the polymer dissolves in the processing solution during processing which form scums. Furthermore, there processes have many production problems.

SUMMARY OF THE INVENTION

Accordingly, an object of the present invention is to provide silver halide photographic sensitive materials which do not cause reticulation at high temperature treatment and have a good scum inhibition property as well as a high covering power.

The object of the present invention has been attained by providing silver halide photographic sensitive materials comprising a base, at least a sensitive silver halide emulsion layer on said base and at least two insensitive layers on the outside of the most exterior sensitive silver halide layer an insensitive layer having a melting time equal to or higher than that of said sensitive silver halide emulsion layer is provided between the insensitive layer having the highest melting time of said insensitive layers and said sensitive silver halide emulsion layer.

DETAILED DESCRIPTION OF THE INVENTION

In one embodiment of the silver halide photographic sensitive materials of the present invention is comprised of two insensitive layers adjacent to the most exterior silver halide emulsion layer. The melting time (hereinafter, referred to as "M.T") of the most exterior insensitive layer (M.Tu) is higher than that of the sensitive silver halide emulsion layer (M.Ts) and M.T of the inside insensitive layer (M.Ti) is equal to or higher than the M.T of the silver halide layer and lower than the M.T of the outside insensitive layer. (Embodiment I)

In the present invention, the sensitive materials may have one or more insensitive layer outside the insensitive layer having the highest M.T. The sensitive materials may also have two or more insensitive layers inside the insensitive layer having the highest M.T.

As described above, the M.T of the insensitive layer between the insensitive layer having the highest M.T and the most exterior sensitive silver halide emulsion layer may be equal to that of the silver halide emulsion layer, but it is preferably higher than that of the silver halide emulsion layer.

The relation between the melting time of the most exterior insensitive layer (M.Tu) and that of the light-sensitive silver halide emulsion layer (MTs) represented by M.Tu/MTs ratis is in a range of more than 1 and less than 20, preferably more than 1 and less than 10, and most preferably more than 3 and less than 6.

In the following, the present invention is illustrated with reference to Embodiment I.

As is known in the art, the degree of hardening can be controlled from layer to layer by the use of non-diffusable hardeners. As such non-diffusable hardeners, various polymeric hardeners which have molecular weight of more than about 10,000 and at least one functional group reactive to gelatin to form cross-linking can be used in the silver halide photographic light-sensitive material of the present invention. These hardeners include those as described in, for example, U.S. Pat. Nos. 3,057,723, 3,396,029, 4,161,407, British Pat. No. 2,064,800 and U.S. application Ser. No. 251,827 filed Apr. 7, 1981. One preferred example of the polymeric hardener is that described in U.S. application Ser. No. 251,827 filed Apr. 7, 1981, which has a repeating unit represented by the following formula (I):

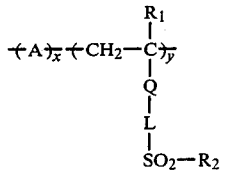

(I)

wherein A is a monomer unit prepared by copolymerizing copolymerizable ethylenically unsaturated monomers; $R_1$ is hydrogen or a lower alkyl group having 1 to 6 carbon atoms; Q is $—CO_2—$,

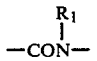

(wherein $R_1$ is the same as defined above) or an arylene group having 6 to 10 carbon atoms; L is a divalent group having 3 to 15 carbon atoms and containing at least one linking group selected from the members consisting of $—CO_2—$ and

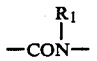

(wherein $R_1$ is the same as defined above) or a divalent group having 1 to 12 carbon atoms and containing at least one linking group selected from the members consisting of

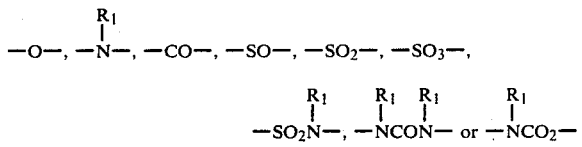

(wherein $R_1$ is the same as defined above); $R_2$ is $—CH=CH_2$ or $—CH_2CH_2X$ (wherein X is a group capable of being substituted with a nucleophilic group or a group capable of being released in the form of HX upon a base; and x and y each represents molar percent, x being between 0 and 99 and y being between 1 and 100.

Examples of ethylenically unsaturated monomers represented by "A" of formula (I) include ethylene, propylene, 1-butene, isobutene, styrene, chloromethylstyrene, hydroxymethylstyrene, sodium vinylbenzenesulfonate, sodium vinylbenzylsulfonate, N,N,N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzyl vinylpyridinium chloride, N-vinylacetamide, N-vinylpyrrolidone, 1-vinyl-2-methylimidazole, monoethylenically unsaturated esters of aliphatic acids (e.g., vinyl acetate and allyl acetate), ethylenically unsaturated mono- or dicarboxylic acids and salts thereof (e.g., acrylic acid, methacrylic acid, itaconic acid, maleic acid, sodium acrylate, potassium acrylate and sodium methacrylate), maleic anhydride, esters of ethylenically unsaturated monocarboxylic or dicarboxylic acids (e.g., n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloyloxyethylammonium-p-toluene sulfonate, N,N-diethyl-N-methyl-N-methacryloyloxyethylammonium-p-toluene sulfonate, dimethyl itaconate and monobenzyl maleate), and amides of ethylenically unsaturated monocarboxylic or dicarboxylic acids (e.g., acrylamide, N,N-dimethylacrylamide, N-methylolacrylamide, N-(N,N-dimethylaminopropyl)acrylamide, N,N,N-trimethyl-N-(N-acryloylpropyl)ammonium-p-toluene sulfonate, sodium 2-acrylamide-2-methylpropane sulfonate, acryloyl morpholine, methacrylamide, N,N-dimethyl-N'-acryloyl propane diamine propionate betaine, and N,N-dimethyl-N'-methacryloyl propane diamine acetate betaine). "A" further includes monomers having at least two copolymerizable ethylenically unsaturated groups (e.g., divinylbenzene, methylenebisacrylamide, ethylene glycol diacrylate, trimethylene glycol diacrylate, ethylene glycol dimethacrylate, trimethylene glycol dimethacrylate and neopentyl glycol dimethacrylate).

Examples of $R_1$ of formula (I) include a methyl group, an ethyl group, a butyl group and an n-hexyl group.

Examples of Q of formula (I) include the following groups:

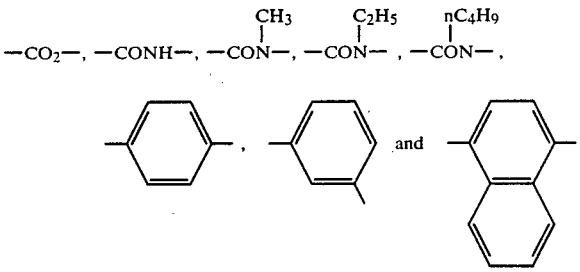

Examples of L of formula (I) include the following groups: $—CH_2CO_2CH_2—$, $—CH_2CO_2CH_2CH_2—$, $—CH_2CH_2CO_2CH_2CH_2—$, $—(CH_2)_5CO_2CH_2CH_2—$, $—(CH_2)_{10}CO_2CH_2CH_2—$, $—CH_2NHCOCH_2—$, $—CH_2NHCOCH_2CH_2—$, $—(CH_2)_3NHCOCH_2CH_2—$, $-(CH_2)_5NHCOCH_2CH_2-$, $-(CH_2)_{10}NHCOCH_2CH_2-$, $-CH_2OCH_2-$, $-CH_2CH_2OCH_2CH_2CH_2-$, $-\overset{CH_3}{\overset{|}{N}}CH_2CH_2-$, $-CH_2\overset{CH_3}{\overset{|}{N}}CH_2CH_2-$, $-COCH_2CH_2-$, $-CH_2COCH_2CH_2-$,

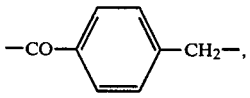

$-SOCH_2CH_2-$, $-CH_2SOCH_2CH_2-$, $-SO_2CH_2CH_2-$, $-SO_2CH_2CH_2SO_2CH_2CH_2-$, $-SO_2CH_2CH_2SO_2CH_2\underset{\underset{OH}{|}}{C}HCH_2-$ $-SO_3CH_2CH_2CH_2-$, $-SO_3CH_2CO_2CH_2CH_2-$, $-SO_3CH_2CH_2CO_2CH_2CH_2-$, $-SO_2NHCH_2CO_2CH_2CH_2-$, $-SO_2NHCH_2CH_2CO_2CH_2CH_2-$, $-NHCONHCH_2CH_2-$ $-CH_2NHCONHCH_2CH_2-$, $-NHCO_2CH_2CH_2-$, $-CH_2NHCO_2CH_2CH_2-$.

Examples of $R_2$ of formula (I) include the following groups: $-CH{=}CH_2$, $-CH_2CH_2Cl$, $-CH_2CH_2Br$, $-CH_2CH_2O_3SCH_3$,

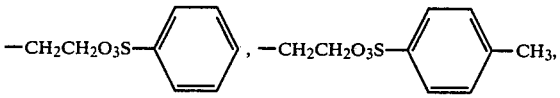

$-CH_2CH_2OH$, $-CH_2CH_2O_2CCH_3$, $-CH_2CH_2O_2CCF_3$ and $-CH_2CH_2O_2CCHCl_2$.

Another preferred example of the polymeric hardener is that described in U.S. Pat. No. 4,161,407, which has a repeating unit represented by the following formula (II):

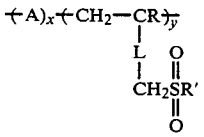

(II)

wherein A is a polymerized $\alpha,\beta$-ethylenically unsaturated addition polymerizable monomer or a mixture of such polymerizable monomers; x and y are the molar percentages of the resulting units in the polymer and are whole integers, x being from 10 to about 95 percent and y being 5 to 90 percent; R is hydrogen or an alkyl group having 1 to 6 carbon atoms; R′ is $-CH{=}CHR_2$ or $-CH_2CH_2X$ where X is a leaving group which is displaced by a nucleophile or eliminated in the form of HX by treatment with base; $R_2$ is alkyl, aryl or hydrogen; —L— is a linking group selected from the group consisting of alkylene, preferably containing about 1 to 6 carbon atoms, such as methylene, ethylene, isobutylene and the like; arylene of about 6 to 12 nuclear carbon atoms, such as phenylene, tolylene, naphthalene and the like; —COZ— or $-COZR_3-$; $R_3$ is alkylene, preferably of 1 to 6 carbon atoms, or arylene, preferably of 6 to 12 carbon atoms; and Z is 0 or NH.

Examples of A of formula (II) include the same examples of A of formula (I), examples of R of formula (II) include the same examples of $R_1$ of formula (I) and examples of R′ of formula (II) include the same examples of $R_2$ of formula (I), all of which are described above.

Still another preferred example of the polymeric hardener is that described in British Pat. No. 1,534,455, which has a repeating unit represented by the following formula (III):

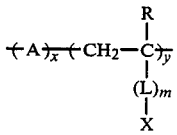

(III)

wherein A is a monomer unit copolymerized with a copolymerizable ethylenically unsaturated monomer; R is a hydrogen atom or an alkyl group having 1 to 6 carbon atoms; L is a divalent linking group having 1 to 20 carbon atoms; X is an active ester group; x and y each represents molar percent, with x being between 0 and 95 and y being between 5 and 100 and m is 0 or 1.

Examples of A of formula (III) include the same examples of A of formula (I) and examples of R of formula (III) include the same examples of $R_1$ of formula (I), both of which are described above.

Examples of L of formula (III) include the following: $-CONHCH_2-$, $-CONHCH_2CH_2-$, $-CONHCH_2CH_2CH_2-$, $-CONHCH_2CH_2CH_2CH_2CH_2-$, $-CO_2CH_2CH_2OCOCH_2CH_2-$, $CONHCH_2CONHCH_2-$ $-CONHCH_2CONHCH_2CONHCH_2-$, $-CO_2CH_2-$, $-CONHCH_2NHCOCH_2CH_2SCH_2CH_2-$, $CONHCH_2OCOCH_2CH_2-$.

Examples of X of formula (III) include the following:

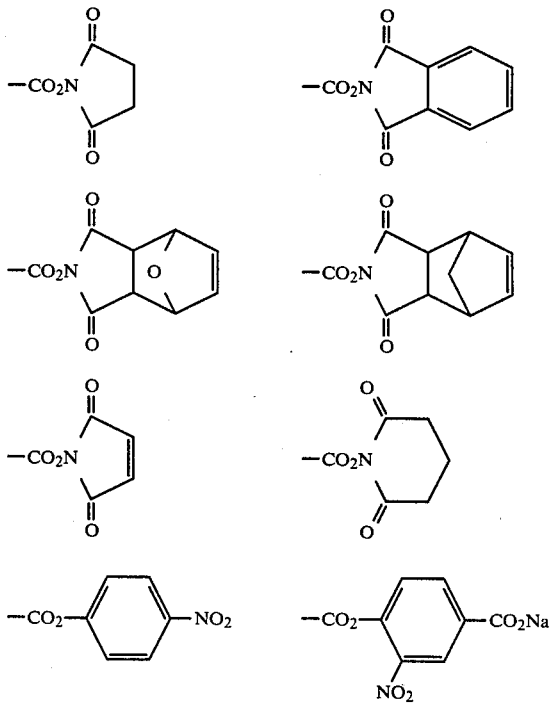

-continued

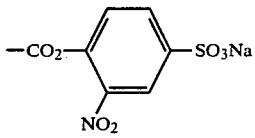

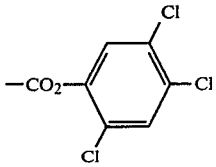

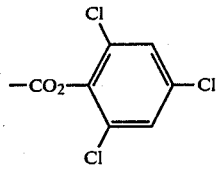

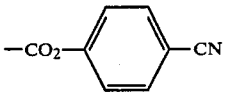

$-CO_2CH_2CN$
$-CO_2CH_2CONH_2$ $-CO_2CH_2CO_2C_2H_5$
$-CO_2CH_2COCH_3$ $-CO_2CH_2CO_2CH{=}CH_2$

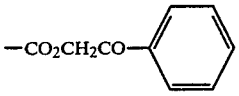

-continued $-CO_2N{=}CHCH_3$ $-CO_2N{=}C(CH_3)_2$ $-CO_2C(CH_3){=}CHCOCH_3$

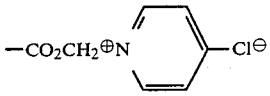

$-CO_2CH_2CH_2Br$ $-CO_2CH_2CH_2CN$ $-CO_2CH_2CH_2\overset{\oplus}{N}(CH_3)_2-CH_3Cl^{\ominus}$ Among the above preferred examples of the polymeric hardeners, the polymeric hardener having repeating unit of formula (I) is particularly preferred.

Typical examples of the polymeric hardener are shown below as P-1 to P-22. Among them, P-1, 2, 6 and 19 are particularly preferred.

P-1

$\left(CH_2CH\right)_x$ $CONHC(CH_3)_2CH_2SO_3Na$ $\left(CH_2CH\right)_y$ $COOCH_2CH_2OCOCH_2SO_2CH{=}CH_2$ x/y = 3/1

P-2

$\left(CH_2CH\right)_x$ $CONHC(CH_3)_2CH_2SO_3Na$ $\left(CH_2CH\right)_y$ $CONHCH_2NHCOCH_2CH_2SO_2CH{=}CH_2$ x/y = 3/1

P-3

$\left(CH_2CH\right)_x$ $CONHC(CH_3)_2CH_2SO_3Na$ $\left(CH_2CH\right)_y$ $CONHCH_2CH_2CH_2NHCOCH_2CH_2SO_2CH{=}CH_2$ x/y = 3/1

P-4

$\left(CH_2CH\right)_x$ $CONHC(CH_3)_2CH_2SO_3Na$

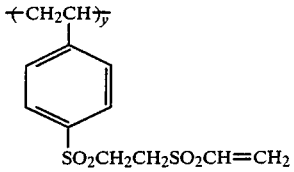

$SO_2CH_2CH_2SO_2CH{=}CH_2$ x/y = 3/1

P-5

$\left(CH_2CH\right)_x$ $CONHC(CH_3)_2CH_2SO_3Na$

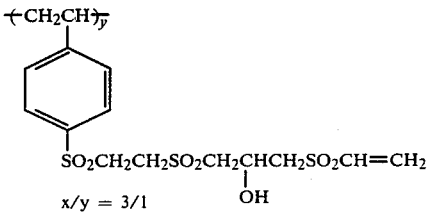

$SO_2CH_2CH_2SO_2CH_2CH(OH)CH_2SO_2CH{=}CH_2$ x/y = 3/1

P-6

$(CH_2CH)_x$ $CONHC(CH_3)_2CH_2SO_3Na$

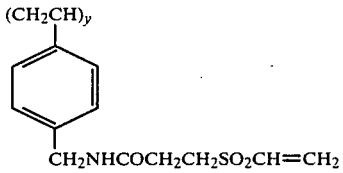

$CH_2NHCOCH_2CH_2SO_2CH{=}CH_2$ x/y = 3/1

-continued

P-7

$$\left(CH_2CH\right)_x \quad \left(CH_2CH\right)_y$$
$$CONHC(CH_3)_2CH_2SO_3Na \quad NHCONHCH_2SO_2CH{=}CH_2$$

x/y = 3/1

P-8

$$\left(CH_2CH\right)_x \quad \left(CH_2CH\right)_y$$
$$CONHC(CH_3)_2CH_2SO_3Na \quad CONHCOCH_2CH_2SO_2CH{=}CH_2$$

x/y = 3/1

P-9

$$\left(CH_2CH\right)_x \quad \left(CH_2CH\right)_y$$
$$CONHC(CH_3)_2CH_2SO_3Na \quad COOCH_2CH_2OCOCH_2SO_2CH_2CH_2Cl$$

x/y = 3/1

P-10

$$\left(CH_2CH\right)_x \quad \left(CH_2CH\right)_y$$
$$CONHC(CH_3)_2CH_2SO_3Na \quad CONHCH_2NHCOCH_2CH_2SO_2CH_2CH_2Cl$$

x/y = 3/1

P-11

$$\left(CH_2CH\right)_x \quad \left(CH_2CH\right)_y$$
$$CONHC(CH_3)_2CH_2SO_3Na \quad CONHCH_2NHCOCH_2CH_2SO_2CH_2CH_2Br$$

x/y = 3/1

P-12

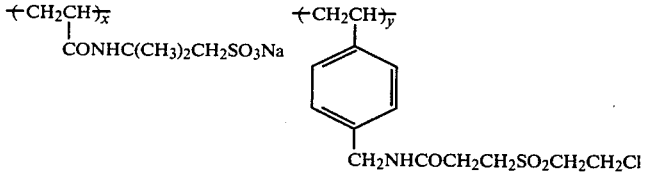

x/y = 3/1

P-13

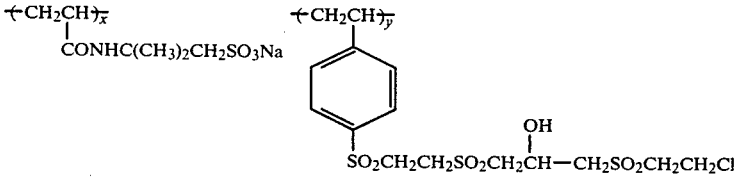

x/y = 3/1

P-14

$$\left(CH_2CH\right)_x \quad \left(CH_2CH\right)_y$$
$$CONHC(CH_3)_2CH_2SO_3Na \quad CONHCOCH_2CH_2SO_2CH_2CH_2Cl$$

x/y = 3/1

P-15

$$\left(CH_2CH\right)_x \quad \left(CH_2CH\right)_y$$
$$COOM \quad CONHCH_2COCH_2CH_2SO_2CH_2CH_2Cl$$

x/y = 3/1

P-16

$$\left(CH_2CH\right)_x \quad \left(CH_2CH\right)_y$$
$$COOM \quad CONHCH_2NHCOCH_2CH_2SO_2CH{=}CH_2$$

x/y = 3/1

P-17

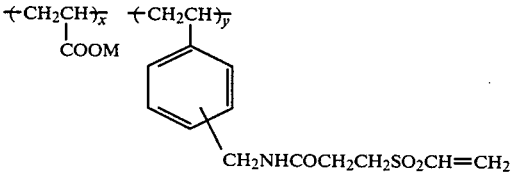

x/y = 3/1

-continued

P-18

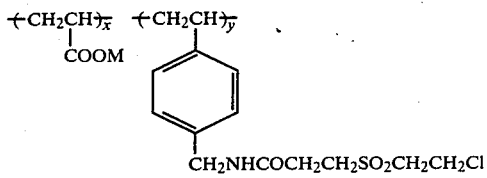

x/y = 3/1

P-19

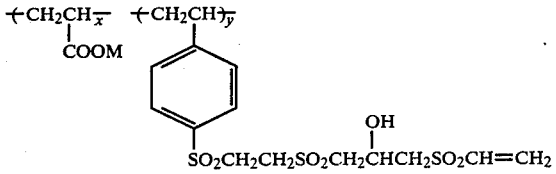

x/y = 3/1

P-20

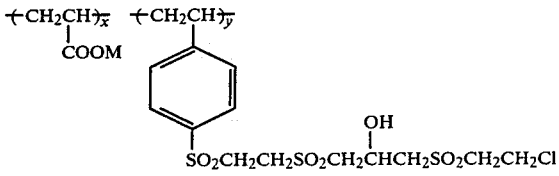

x/y = 3/1

P-21

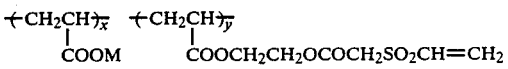

x/y = 3/1

P-22

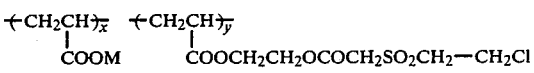

x/y = 3/1

In the above formulae, M is a hydrogen atom, a sodium atom or a potassium atom, and x and y represent the molar percent of the corresponding units charged. The molar percent is not limited to those specified in the above formulae, x may be from 0 to 99, and y, from 1 to 100. Preferably, x is 75 to 0 mol % and y is 25 to 100 mol %, and more preferably x is 75 to 25 mol % and y is 25 to 75 mol %.

Of the above compounds, P-1, P-2, P-5, P-6, and P-19 are preferred with P-1, P-2 and P-5 being most preferred.

Usually, the polymeric hardener of the present invention is used in an amount such that it contains from $0.1\times10^{-3}$ to $30\times10^{-3}$ equivalent of functional group reactive to gelatin per 100 g of gelatin. A particularly preferable range is from $0.5\times10^{-3}$ to $10\times10^{-3}$ equivalent per 100 g of gelatin.

Methods of synthesizing typical ethylenically unsaturated monomers containing a vinyl sulfone group or its precursor which are used in the preparation of polymeric hardeners for use in the invention will hereinafter be described.

PREPARATION EXAMPLE 1

Synthesis of 2-[3-(Chloroethylsulfonyl)propionyloxy]ethyl Acrylate

A mixture of 600 ml of tetrahydrofuran, 45.8 g of hydroxyethyl acrylate, and 72 g of 3-(2-chloroethylsulfonyl)propionic acid chloride was placed in a reactor, and while maintaining the temperature at 5° C. or lower by cooling by ice water, a solution of 31.2 g of pyridine in 100 ml of tetrahydrofuran was added dropwise thereto over a period of 1.75 hours. The resulting mixture was further stirred for 2 hours at room temperature. At the end of the time, the reaction mixture was poured into 2,500 ml of ice water, and extraction was performed four times with 300 ml of chloroform. The organic layer thus extracted was dried over sodium sulfate and concentrated to provide 87 g of 2-[3-(chloroethylsulfonyl)propionyloxy]ethyl acrylate. Yield was 88%.

PREPARATION EXAMPLE 2

Synthesis of [3-(Chloroethylsulfonyl)propionyl]aminomethylstyrene

A mixture of 100 ml of tetrahydrofuran, 20.1 g of vinylbenzylamine, 16.7 g of triethylamine, and 0.1 g of hydroquinone was placed in a reactor, and while cooling with ice water, a solution of 36.1 g of β-chloroethylsulfonylpropionic acid chloride in 200 ml of tetrahydrofuran was added dropwise thereto over a period of 30 minutes. The resulting mixture was allowed to stand overnight at room temperature. The reaction mixture was then poured into a solution prepared by diluting 16.5 g of concentrated hydrochloric acid with 1,500 ml of ice water, and a precipitate was filtered off. The precipitate was recrystallized from a mixed solvent of 200 ml of ethanol and 200 ml of water to provide 26.8 g of N-vinylbenzyl-β-chloroethylsulfonyl propionic acid amide. Yield was 57%.

Elemental analysis (found): H, 5.74; C, 53.47; N, 4.83; Cl, 10.99; S, 10.49.

PREPARATION EXAMPLE 3

Synthesis of 1-{[2-(4-Vinylbenzenesulfonyl)ethyl]sulfonyl}-3-chloroethylsulfonyl-2-propanol A mixture of 157 g of 1,3-bischloroethylsulfonyl-2-propanol (prepared by the method disclosed in British Pat. No. 1,534,455), 1,000 ml of methanol, and 1,000 ml of distilled water was placed in a reactor, and while maintaining the temperature at 46° C., a solution prepared by dissolving 52 g of potassium vinylbenzenesulfinate in 100 ml of methanol and 100 ml of distilled water was added dropwise thereto over a period of 1 hour. The resulting mixture was further stirred for 5.5 hours while maintaining at 46° C. The precipitate thus formed was filtered off to obtain 55 g of 2-(1-vinylbenzenesulfonyl)ethylsulfonyl-3-chloroethylsulfonyl-2-propanol. Yield was 49%.

Elemental analysis (found): H, 4.67; C, 39.89; S, 21.43.

PREPARATION EXAMPLE 4

Synthesis of N-{[3-(Vinylsulfonyl)propionyl]aminomethyl}acrylamide

In a 2,000 ml reactor was introduced 1,400 ml of distilled water, 224 g of sodium sulfite, and 220 g of sodium hydrogencarbonate, which were then stirred to form a uniform solution. Then, while maintaining the temperature at about 5° C. by cooling with ice water, 260 g of chloroethanesulfonyl chloride was added dropwise thereto over a period of 1.5 hours. After the dropwise addition was completed, 160 g of 49% sulfuric acid was added dropwise thereto over a period of about 15 minutes, and the resulting mixture was stirred for 1 hour at 5° C. Crystals precipitated were collected by filtration and washed with 400 ml of distilled water. The filtrate and the washing liquid were combined together and placed in a 3,000 ml reactor. Into the reactor was introduced dropwise a solution of 246 g of methylenebisacrylamide in 480 ml of distilled water and 1,480 ml of ethanol while maintaining the temperature at about 5° C. over a period of 30 minutes. The reactor was then placed in a refrigerator and was allowed to stand for 5 days to complete the reaction. Crystals precipitated were collected by filtration and, thereafter, they were washed with 800 ml of distilled water and recrystallized from 2,000 ml of a 50% aqueous solution of ethanol to obtain 219 g of the desired monomer. Yield was 49%.

In addition, methods of synthesizing polymeric hardeners which are preferably used in the present invention will hereinafter be described.

PREPARATION EXAMPLE 5

Synthesis of 2-[3-(Vinylsulfonyl)propionyloxy]ethyl Acrylate/Sodium Acrylamido-2-methylpropanesulfonate Copolymer (P-1)

A mixture of 60 ml of N,N-dimethylformamide, 14.5 g of 2-[3-(chloroethylsulfonyl)propionyloxy]ethyl acrylate, and 23.5 g of acrylamido-2-methylpropanesulfonic acid was placed in a reactor. After purging with nitrogen gas, the mixture was heated to 60° C., and 0.40 g of 2,2'-azobis(2,4-dimethylvaleronitrile) was added thereto. The resulting mixture was stirred for 2 hours while heating at that temperature. Subsequently, 0.2 g of 2,2'-azobis(2,4-dimethylvaleronitrile) was added, and the mixture was stirred for 2 hours while heating. At the end of the time, the mixture was cooled down to 5° C., and 12 g of sodium carbonate and 4.9 g of triethylamine were added. The resulting mixture was stirred for 1 hour and additionally for 1 hour at room temperature. The reaction mixture was placed in a tube of cellulose and was subjected to dialysis for 2 days. The product was freeze-dried to obtain 35 g of a white polymer. Yield was 95%.

The vinylsulfone content of the polymer thus formed was $0.51\times10^{-3}$ equivalent/g.

PREPARATION EXAMPLE 6

Synthesis of [3-(Chloroethylsulfonyl)propionyl]aminomethylstyrene/Sodium Acrylamido-2-methylpropanesulfonate Copolymer (P-6)

A mixture of 15.8 g of [3-(vinylsulfonyl)propionyl]aminomethylstyrene, 23.6 g of sodium acrylamido-2-methylpropanesulfonate, and 75 ml of N,N-dimethylformamide was placed in a reactor. After purging with nitrogen gas, the mixture was heated to 80° C., and 0.75 g of 2,2'-azobis(2,4-dimethylvaleronitrile) was added thereto. The resulting mixture was stirred for 3 hours while heating. Then, 25 ml of N,N-dimethylformamide was added, and subsequently 6.1 g of triethylamine was added dropwise at room temperature. The resulting mixture was stirred for 1 hour at room temperature. At the end of the time, the reaction mixture was filtered. The filtrate thus obtained was poured into 800 ml of acetone, and the thus-formed precipitate was filtered off and dried to obtain 36.2 g of pale yellow polymer. Yield was 94%.

The vinylsulfone content of the polymer was $0.80\times10^{-3}$ equivalent/g.

PREPARATION EXAMPLE 7

Synthesis of 1-{[2-(4-Vinylbenzenesulfonyl)ethyl]sulfonyl}-3-chloroethylsulfonyl-2-propanol/Sodium Acrylate Copolymer (P-19)

A mixture of 300 ml of N,N-dimethylformamide, 40.1 g of 2-(1-vinylbenzenesulfonyl)ethyl)ethylsulfonyl-3-chloroethylsulfonyl-2-propanol, and 13.0 g of acrylic acid was placed in a reactor. After purging with nitrogen gas, the mixture was heated to 70° C., and 0.53 g of 2,2'-azobis(2,4-dimethylvaleronitrile) was added thereto. The resulting mixture was heated for 1.5 hours while stirring. Subsequently, 0.53 g of 2,2'-azobis(2,4-dimethylvaleronitrile) was added thereto, and the mixture was further heated for 1 hour while stirring. The reaction mixture was allowed to cool down to room temperature, and 54.8 g of a 28% methanol solution of sodium methylate was added dropwise thereto. Stirring was further continued for 1 hour. The reaction mixture was placed in a tube of cellulose and was subjected to dialysis for 2 days. The product was freeze-dried to obtain 30 g of pale yellow polymer. Yield was 56%.

The vinylsulfone content of the polymer was $1.4\times10^{-3}$ equivalent/g.

PREPARATION EXAMPLE 8

Synthesis of Polymer (P-2)

A mixture of 5.65 g of the monomer prepared in Preparation Example 1, 9.16 g of sodium acrylamido-2-methylpropanesulfonate, and 80 ml of a 50% aqueous solution of ethanol was placed in a 200 ml reactor, and was heated to 80° C. while stirring. At this temperature, 0.1 g of 2,2'-azobis(2,4-dimethylvaleronitrile) (sold by Wako Pure Chemical Industries Ltd. under the trade name of V-65) was added and additionally, after 30 minutes, 0.1 g of the same compound as above was added. The mixture was heated for 1 hour while stirring. Thereafter, the reaction mixture was cooled down to about 10° C. with ice water, and a solution of 2.5 g of triethylamine in 80 ml of ethanol was added thereto. Stirring was further continued for 1 hour. At the end of the time, the reaction mixture was poured into 1,000 ml of acetone while stirring, and the thus-formed precipitate was filtered off to obtain 12.4 g of Polymer (P-2). Yield was 85%.

The intrinsic viscosity, [$\eta$], was 0.227, and the vinylsulfone content was $0.95\times10^{-3}$ equivalent/g.

In hardening emulsion layers, polymeric hardeners as described hereinbefore may be used either singly or in combination with diffusible low-molecular hardeners. Diffusible hardeners which can be used include various organic and inorganic hardeners which are used either singly or in combination with each other. Typical examples of such hardeners include aldehyde compounds, e.g., mucochloric acid, formaldehyde, trimethylolmelamine, glyoxal, 2,3-dihydroxy-1,4-dioxane, 2,3-dihydroxy-5-methyl-1,4-dioxane, succinaldehyde, and glutaraldehyde; active vinyl compounds, e.g., divinyl sulfone, methylenebismaleimide, 1,3,5-triacryloyl-hexahydro-s-triazine, 1,3,5-trivinylsulfonyl-hexahydro-s-triazine, bis(vinylsulfonylmethyl)ether, 1,3-bis(vinylsulfonyl)propanol-2, bis($\alpha$-vinylsulfonylacetoamido)-ethane, 1,2-bis(vinylsulfonyl)ethane, and 1,1'-bis(vinylsulfonyl)methane; active halogeno compounds, e.g., 2,4-dichloro-6-hydroxy-6-methoxy-s-triazine; and ethyleneimine compounds, e.g., 2,4,6-triethyleneimino-s-triazine. These compounds are well known in the art as hardeners for gelatin. Of these, active vinyl compounds and active halogen compounds are preferred.

These polymeric hardeners are dissolved in water or organic solvents and, thereafter, are added directly to a layer in order to control the degree of hardening of that particular layer. In the case of diffusible hardeners, they may be added directly to the layer which is to be controlled in the degree of hardening, or alternatively they may be added to another layer and then diffused in the whole layer. The amount of the non-diffusible hardener added is determined by the amount of the reactive group in the polymeric hardener.

Non-diffusible hardeners may be used either singly or in combination with diffusible hardeners.

In accordance with another technique to control the degrees of hardening of coating layers, low molecular hardeners are employed. By controlling the method of addition and drying conditions, diffusion properties are controlled. For example, a low molecular weight hardener containing a vinylsulfone group is incorporated into only a coating solution for a surface protective layer and, after a plurality of layers are coated at the same time, the layers are rapidly dried whereby the degree of hardening can be changed from layer to layer.

Measures well known in the art for evaluation of the degree of hardening of a hardened layer include the degree of swelling as determined by swelling the hardened layer in a certain solution, and the scratching strength which is indicated by determining the load at which the hardened layer is scratched by a needle-like stylus under the load. However, in order to evaluate the prevention of scum (which is the primary purpose of the present invention), it is most effective to employ a melting time (MT). The melting time is the time required for a hardened layer to melt when it is soaked in a solution maintained at a certain temperature. It is most preferred to measure the melting time in a 0.2N NaOH solution maintained at 60° C. although the present invention is not limited thereto.

Silver halide emulsions as used herein are ordinarily prepared by mixing water-soluble silver salt (e.g., silver nitrate) solutions and water-soluble halogenide (e.g., potassium bromide) solutions in the presence of water-soluble polymer (e.g., gelatin) solutions.

Silver halides which can be used include mixed silver halides, e.g., silver chlorobromide, silver iodobromide, and silver chloroiodobromide, as well as silver chloride, silver bromide, and silver iodide.

These silver halide grains can be prepared by the usual techniques. It is also useful to prepare them by the so-called single or double jet method, and control double jet method, and so forth.

Photographic emulsions are well known as described in, for example, Mees, *The Theory of Photographic Process,* Macmillan Corp., and P. Glafkides, *Chimie Photographique,* Paul Montel (1957), and can be prepared by various known techniques such as an ammonia method, a neutral method, and an acidic method.

Silver halide emulsions are usually subjected to chemical sensitization although so-called primitive emulsions not subjected to chemical sensitization may be used. Chemical sensitization can be achieved by the methods as described in the above-described reference by P. Glafkides, the book by Zelikman, and H. Frieser Ed., *Die Grundlagen der Photographischen Prozesse mit Silberhalogeniden,* Akademische Verlagsgesellschaft (1968).

A sulfur sensitization method in which compounds containing sulfur capable of reacting with a silver ion, and active gelatin are used, a reduction sensitization method in which reducing compounds are used, a noble metal sensitization method in which gold and other noble metal compounds are used, and so forth can be used either singly or in combination with each other.

Sulfur sensitizers which can be used include thiosulfates, thioureas, thiazoles, and rhodanines. These compounds are described in U.S. Pat. Nos. 1,574,944, 2,410,689, 2,278,947, 2,728,668, 3,656,955, 4,030,928 and 4,067,740. Reduction sensitizers which can be used include stannous salts, amines, hydrazines derivatives, formamidinesulfinic acid, and silane compounds. These compounds are described in U.S. Pat. Nos. 2,487,850, 2,419,974, 2,518,698, 2,983,609, 2,983,610, 2,694,637, 3,930,867 and 4,054,458. For noble metal sensitization, in addition to gold complex salts, complex salts of Group VIII metals, e.g., platinum, iridium, and palladium, of the Periodic Table can be used. These compounds are described in U.S. Pat. Nos. 2,399,083 and 2,448,060, and British Pat. No. 618,061.

Hydrophilic colloids which can be used in the present invention as binders for silver halide include high molecular weight gelatin, colloidal albumin, casein, cellulose derivatives, e.g., carboxymethyl cellulose, and hydroxyethyl cellulose, sugar derivatives, e.g., agar, sodium alginate, and starch derivatives, and synthetic hydrophilic colloids, e.g., polyvinyl alcohol, poly-N-vinylpyrrolidone, polyacrylic acid copolymers, and polyacrylamide, or their derivatives or partially hydrolyzed products. If necessary, mixtures comprising two or more mutually soluble colloids of the above-described compounds may be used. Of the above-described compounds, gelatin is most commonly used. Part or the whole of gelatin may be displaced by a synthetic polymeric substance. In addition, it may be displaced by a graft polymer prepared by bonding molecular chains of other polymeric substances. Furthermore, gelatin derivatives prepared by treating the usual high molecular weight gelatin with reagents containing a group capable of reacting with an amino group, an imino group, a hydroxy group, or a carboxy group contained in the gelatin may be used partially.

Various compounds may be incorporated into the photographic emulsions used herein for the purpose of preventing the formation of fog during the production of light-sensitive materials or the storage thereof, or of stabilizing photographic performance. Compounds which can be used for that purpose include azoles, e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (especially, 1-phenyl-5-mercaptotetrazole); mercaptopyrimidines; mercaptotriazines; thioketo compounds e.g., oxazolinethion; azaindenes, e.g., triazaindenes, tetraazaindenes (especially, 4-hydroxy-substituted (1,3,3a,7) tetraazaindenes), and pentaazaindenes; and benzenethiosulfonic acid, benzenesulfinic acid, and benzenesulfonic acid amide, which are known as anti-foggants or stabilizers.

Photographic emulsion layers and other hydrophilic colloid layers in the light-sensitive materials of the present invention may contain various known surfactants as coating aids or for various purposes of prevention of charging, improvement of sliding properties, emulsification and dispersion, prevention of adhesion, and improvement of photographic characteristics (e.g., acceleration of development, high contrast, and sensitization).

Photographic emulsions as used herein may be subjected to spectral sensitization using methine dyes, etc. Dyes which can be used include cyanine dyes, merocyanine dyes, composite cyanine dyes, composite merocyanine dyes, holopolar cyanine dyes, hemicyanine dyes, styryl dyes, and hemioxonol dyes.

Photographic emulsion layer or their adjacent layers in the photographic light-sensitive materials of the present invention may contain, for the purpose of increasing sensitivity, increasing contrast, or for accelerating development, polyalkyleneoxide or its ether, ester, amine or like derivatives, thioether compounds, thiomorpholines, quaternary ammonium chloride compounds, urethane derivatives, urea derivatives, imidazole derivatives, 3-pyrazolidones, and the like.

There are no limitations on surfactants, chemical sensitizers, silver halide, stabilizers, anti-foggants, antistatic agents, matting agents, spectral sensitizing dyes, dyes, color couplers, supports, and so forth, which are used in the silver halide emulsion layers and other hydrophilic colloid layers of the present invention. These additives are described in, for example, *Research Disclosure,* Vol. 176, pp. 22–31 (Dec. 1978) and Japanese Patent Application (OPI) No. 99928/78 (the term "OPI" as used herein refers to a "published unexamined Japanese patent application").

The light-sensitive material of the present invention is characterized in that the uppermost layer lying on a silver halide emulsion layer has a melting time longer than that of the silver halide emulsion layer.

The relation between the melting time of the uppermost layer (MTu) and that of the light-sensitive silver halide emulsion layer (MTs) employed in the present invention can be represented by MTu/MTs ratio. The ratio is usually in a range of more than 1 and less than 20, preferably more than 1 and less than 10, and most preferably more than 3 and less than 6.

The silver halide light-sensitive photographic materials of the present invention may include those having at least one of the light-sensitive silver halide emulsion layer on both sides of the support and the uppermost layer on the outside of the outermost silver halide emulsion layer existed on both sides of the support.

The uppermost layer existed in the silver halide light-sensitive photographic material of the present invention has a thickness of from about 0.5 to about 2.0 microns.

If necessary, a gelatin overcoat layer may be provided on the uppermost layer. It is preferred for such overcoat layers to have melting times shorter than that of the emulsion layer and to be as thin as possible. The gelatin overcoat layer described above should have a thickness of less than 0.5 microns.

A method of exposure of the light-sensitive material of the invention is not critical, and the exposure time may be either as long as from 1 second to several minutes or as short as from $10^{-6}$ to $10^{-3}$ second.

Preferred examples of automatic developing machines which can be used in the development of the light-sensitive material of the present invention include a roller conveyor type automatic developing machine, a belt conveyor type automatic developing machine, and a hanger type automatic developing machine. The development processing temperature is preferably from 20° to 60° C. and more preferably from 27° to 45° C., and the development time is preferably from 10 seconds to 10 minutes and more preferably from 20 seconds to 5 minutes. Development procesing steps, the composition of processing liquids, and so forth may be chosen referring to the above-described references and also to C. E. K. Mees and T. H. James, *The Theory of Photographic Processes,* 3rd Ed., Chapter 13, Macmillan Co. (1966) and L. F. A. Mason, *Photographic Processing Chemistry,* pp. 16–30, Oxford Press (1966).

Examples of useful silver halide photographic sensitive materials include conventional black-white sensitive materials, X-ray sensitive materials, sensitive materials for printing, color sensitive materials and color reversal sensitive materials, etc.

In the following, the present invention is illustrated with reference to examples, but the present invention is not limited to them.

EXAMPLE 1

On both sides of a polyethylene terephthalate film base having a thickness of about 175$\mu$ the both surfaces of which were subjected to undercoating, layers having the following compositions were provided in turn to prepare Samples 1 to 6.

Each layer of each sample contained a hardening agent as shown in Table 1. In Table 1, H-1 is 1,2-bis(-vinylsulfonylacetamide)ethane.

(Emulsion layer)

Binder: Gelatine—2.0 g/m$^2$

Coating amount of silver: 20 g/m$^2$

Composition of silver halide: AgI 2% by mol+AgBr 98% by mol

Antifoggant:

1-Phenyl-5-mercaptotetrazole 0.5 g/Ag 100 g

4-Hydroxy-(1,3,3a,7)tetraazaindene 0.8 g/Ag 100 g (Intermediate layer)

Binder: Gelatine 1.3 g/m$^2$

Coating assistant: N-oleoyl-N-methyltaurine sodium salt 3 mg/m$^2$ (Protective layer)

Binder: Gelatine 0.6 g/m$^2$ or 1.3 g/m$^2$

Coating assistant: N-oleoyl-N-methyltaurine sodium salt 7 mg/m$^2$

Matting agent: Polymethyl acrylate (average particle size 5$\mu$) 25 mg/m$^2$

The hardness of each layer of these samples were measured by the following method. The coated sample was cut into 0.5 cm widths and 4 cm lengths and immersed in an alkali solution (0.2N aqueous solution of sodium hydroxide) kept at 60° C. The time at which dissolution of the emulsion layer and the upmost layer began was measured to determine the melting time (second: M.T).

The film strength was measured as follows. After the coated sample was immersed in the developing solution RD-III at 35° C. for 25 seconds, a needle equipped with a stainless steel ball having a diameter of 0.5 mm on the tip end thereof was pressed against the film face. The weight applied to the needle was continuously varied while moving the film at a rate of 5 mm/sec. The film strength was represented by the weight (g) at which the film was broken (occurrence of a scratch).

The sensitometric characteristic was measured after the sample was exposed to light for 1/20 seconds using a conventional tungsten sensitometer and developed by an automatic development apparatus as follows.

| Processing step | Processing temperature | Processing time |
|---|---|---|
| Development | 35° C. | 23 seconds |
| Fixation | 33° C. | 23 seconds |
| Water wash | 33° C. | 16 seconds |
| Draining | — | 11 seconds |
| Drying | 50° C. | 18 seconds |

The developing solution used was one commercially available for ultra-rapid treatment: RD-III for Fuji X-ray automatic development apparatus (produced by Fuji Photo Film Co.).

The fixing solution used was a commercially available fixing solution for X-ray automatic development apparatus: Fuji F (produced by Fuji Photo Film Co.).

The covering power is a value calculated by dividing a value obtained by subtracting the density of the base from the maximum density by the amount of silver (g/m$^2$), which means the density resulting from the same amount of silver. Namely, the same density can be obtained with a smaller amount of silver if the value of covering power is larger.

After carrying out the same development processing as described above, the degree of reticulation on each sample was examined. The degree of reticulation is indicated by the following three stages A, B and C.

A: Reticulation is not observed at all when magnified to 100 times by a microscope.

B: Reticulation is slightly observed when magnified to 100 times by a microscope.

C: Reticulation is remarkably observed when magnified to 100 times by a microscope.

The examination of scum was carried out as follows. 200 Sheets of coating samples 8.5 cm in width and 30 cm in length were allowed to pass through a potable automatic development apparatus equipped with a 2 l developing bath and a 2 l fixing bath in which RD-III and Fuji-F were used, and the degree of muddiness of each processing solution and the degree of pollution of the processed film were examined.

The degree of pollution of the processed film (degree of scum occurrence) was shown by the following four stages A, B, C and D.

A: Pollution is not caused at all up to 200 sheets of processed film.

B: Pollution is slightly caused in the range of 150 to 200 sheets of processed film.

C: Occurrence of scum is slightly observed when 100 sheets or more were processed.

D: Occurrence of scum is considerably observed when 25 sheets or more were processed.

Further, the amount of gelatine dissolved in the development processing solution was determined by gel-chromatography (Matrix: Sephadex G-50). The amount of gelatine contained in 100 cc of the developing solution is shown as milligram. The results are shown in Table 2.

Table 2 clearly shows that the occurrence of reticulation is remarkably improved by the present invention. Further, the covering power is high and the scum inhibition property is remarkably improved. Particularly remarkable effects are observed in Samples 7 and 8.

As shown in Comparison Samples 1 and 2, when both the upmost layer and emulsion layer have the same melting time shorter melting time (Comparison Sample 1) give rise to higher covering power but scum muddiness of the fixing solution is undesirably high. On the other hand, longer melting time (Comparison Sample 2) results in lower although no problem with respect to scum occurs. Scum does not appear with longer melting time for the uppermost layer and shorter melting time for emulsion layer as in Comparison Samples 3 and 4. In this case, however, there arises a problem of reticulation resulting in lowered covering power. Even when the difference in melting time is the same as between Comparison Samples 3 and 4, provision of an inter layer between the uppermost layer and the emulsion layer obviates all the problems with respect to scum, coating power and reticulation.

TABLE 1

| Sample No. | The Upmost Layer Hardening Agent for Gelatine Milliequivalent/ Gelatine in the Uppermost Layer 100 g | Intermediate layer Hardening Agent for Gelatine Milliequivalent/ Gelatine in Intermediate Layer | Presence or Absence | Emulsion Layer Hardening Agent for Gelatine Millimole/Gelatine in All Layers 100 g |
|---|---|---|---|---|
| 1. Comparison | No addition | — | Absence | H-1 (0.40) |
| 2. " | " | — | " | H-1 (1.30) |
| 3. " | Polymer Hardening Agent P-2 (1.8) | — | " | H-1 (0.40) |
| 4. " | Polymer Hardening Agent P-5 (1.8) | — | " | H-1 (0.40) |
| 5. Present Invention | Polymer Hardening Agent P-2 (1.8) | No Addition | Presence | H-1 (0.40) |
| 6. Present Invention | Polymer Hardening Agent P-5 (1.8) | No Addition | " | H-1 (0.40) |
| 7. Present Invention | Polymer Hardening Agent P-2 (1.8) | Polymer Hardening Agent P-1 (0.9) | " | H-1 (0.40) |
| 8. Present Invention | Polymer Hardening Agent P-5 (1.8) | Polymer Hardening Agent P-5 (0.9) | " | H-1 (0.40) |

TABLE 2

| Sample No. | Melting Time O.2N, NaOH, 60° C. The Upmost Layer (Seconds) | Melting Time O.2N, NaOH, 60° C. Emulsion Layer (Seconds) | Film Strength (g) | Degree of Reticulation | Covering Power | Scum Muddiness of Fixing Solution | Pollution of processed Film | Amount of Gelatine Dissolved (mg/100 cc of developing solution |
|---|---|---|---|---|---|---|---|---|
| 1. Comparison | 36 | 36 | 50 | A | 0.90 | X | D | 210 |
| 2. " | 290 | 290 | 75 | A | 0.50 | | A | 98 |
| 3. " | 320 | 38 | 51 | C | 0.57 | | A | 95 |
| 4. " | 335 | 39 | 52 | C | 0.54 | | A | 93 |
| 5. Present Invention | 319 | 38 | 52 | A-B | 0.82 | | A | 93 |
| 6. Present Invention | 330 | 40 | 53 | A-B | 0.83 | | A | 94 |
| 7. Present Invention | 328 | 39 | 53 | A | 0.90 | | A | 95 |
| 8. Present Invention | 340 | 41 | 54 | A | 0.89 | | A | 92 |

Notes: Symbol "X" indicates that scum muddiness of fixing solution is noted with naked eye, while symbol " " that it is not observed with naked eye.

What is claimed is:

1. A silver halide photographic sensitive material, comprising:

a support base;

a sensitive silver halide emulsion layer on the support base;

a first insensitive layer positioned on the silver halide emulsion layer; and a second insensitive layer positioned on the first insensitive layer, wherein the second insensitive layer has a melting time higher than the first insensitive layer which has a melting time equal to or higher than that of the silver halide emulsion layer, wherein the second insensitive layer is hardened with a non-diffusible polymeric hardener.

2. The silver halide light-sensitive photographic material as claimed in claim 1, wherein the relation between the melting time of the most exterior layer (M.Tu) and that of the light-sensitive silver halide emulsion layer (M.Ts) represented by M.Tu/M.Ts ratio is in a range of more than 1 and less than 20.

3. The silver halide light-sensitive photographic material as claimed in claim 1, wherein the relation between the melting time of the most exterior layer (M.Tu) and that of the light-sensitive silver halide emulsion layer (M.Ts) represented by M.Tu/M.Ts ratio is in a range of more than 1 and less than 10.

4. The silver halide light-sensitive photographic material as claimed in claim 1, wherein the relation between the melting time of the most exterior layer (M.Tu) and that of the light-sensitive silver halide emulsion layer (M.Ts) represented by M.Tu/M.Ts ratio is in a range of more than 3 and less than 6.

5. A silver halide photographic sensitive material, as claimed in claim 1, wherein the second insensitive layer is the outermost layer.

6. The silver halide photographic sensitive material, as claimed in claim 1, wherein the first insensitive layer has a melting time higher than that of the silver halide emulsion layer.

7. The silver halide photographic sensitive material, as claimed in claim 1, wherein the second insensitive layer is further comprised of a matting agent.

8. The silver halide photographic sensitive material, as claimed in claim 1, wherein the second insensitive layer is further comprised of an antistatic agent.

9. The silver halide photographic sensitive material, as claimed in claim 1, wherein the polymeric hardener is a polymer having a repeating unit having a vinyl-sulfone group.

10. The silver halide photographic sensitive material, as claimed in claim 1, wherein the second insensitive layer is further comprised of a low molecular weight diffusible hardening agent.

11. The silver halide photographic sensitive material, as claimed in claim 1, wherein the first insensitive layer and the second insensitive layer have a thickness within the range of 0.2 to 5$\mu$.

12. The silver halide photographic sensitive material, as claimed in claim 7, wherein the first insensitive layer and the second insensitive layer have thicknesses within the range of 0.3 to 2$\mu$.

13. The silver halide light-sensitive photographic material as claimed in claim 1, wherein at least one of the light-sensitive silver halide emulsion layer is provided on both sides of the support and the uppermost layer is provided on the outside of the outermost silver halide emulsion layer existed on both sides of the support.

14. The silver halide light-sensitive photographic material as claimed in claim 1, wherein the plurality of layers contain non-diffusible polymeric hardeners.

15. The silver halide light-sensitive photographic material as claimed in claim 14, wherein the non-diffusible polymeric hardener has molecular weight of more than about 10,000 and at least one functional group reactive to gelatin to form cross-linking.

16. The silver halide light-sensitive photographic material as claimed in claim 14, wherein the non-diffusible polymeric hardener has a repeating unit of the formula (I):

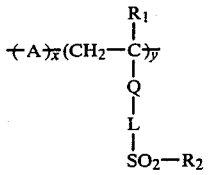

(I)

wherein A is a monomer unit prepared by copolymerizing copolymerizable ethylenically unsaturated monomers; $R_1$ is hydrogen or a lower alkyl group having 1 to 6 carbon atoms;

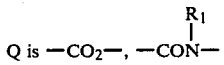

(wherein $R_1$ is the same as defined above) or an arylene group having 6 to 10 carbon atoms; L is a divalent group having 3 to 15 carbon atoms and containing at least one linking group selected from the members consisting of $—CO_2—$ and

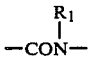

(wherein $R_1$ is the same carbon atoms and containing at least one linking group selected from the members consisting of —O—,

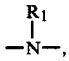

—CO—, —SO—, $—SO_2—$, $—SO_3—$,

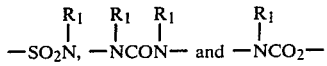

(wherein $R_1$ is the same as defined above); $R_2$ is $—CH{=}CH_2$ or $—CH_2CH_2X$ (wherein X is a group capable of being substituted with a nucleophilic group or a group capable of being released in the form of HX upon a base); and x and y each represents molar percent, x being between 0 and 99 and y being between 1 and 100.

17. The silver halide light-sensitive photographic material as claimed in claim 14, wherein the non-diffusible polymeric hardener has a repeating unit of the formula (II):

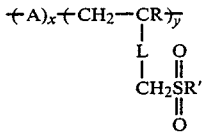

(II)

wherein A is a polymerized $\alpha,\beta$-ethylenically unsaturated addition polymerizable monomer or a mixture of such polymerizable monomers, x is a molar unit of from 10 to 95, and y is a molar unit of from 5 to 90, L is a linking group selected from the group consisting of alkylene, arylene, COZ and $COZR_3$, $R_3$ is selected from the group consisting of alkylene and arylene, Z is O or NH, R is hydrogen or alkyl having 1 to 6 carbon atoms, and R' is $—CH{=}CHR_2$ or $—CHCH_2X$ where X is a leaving group which can be displaced by a nucleophile or can be eliminated in the form of HX upon treatment with base and $R_2$ is hydrogen, alkyl or aryl.

18. The silver halide light-sensitive photographic material as claimed in claim 14, wherein the non-diffusible polymeric hardener contains (i) 5 to 100 molar percent of a repeating unit of the general formula (III):

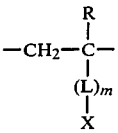

(III)

wherein R is a hydrogen atom or an alkyl group having 1 to 6 carbon atoms; L, if present, is a divalent linking group having 1 to 20 carbon atoms; X is an active carboxylic ester group; and m is 0 or 1; and optionally contains (ii) 0 to 95 molar percent of one or more other monomer unit "A".

19. The silver halide light-sensitive photographic material as claimed in claim 14, wherein the non-diffusible polymeric hardener has a repeating unit selected from the group consisting of:

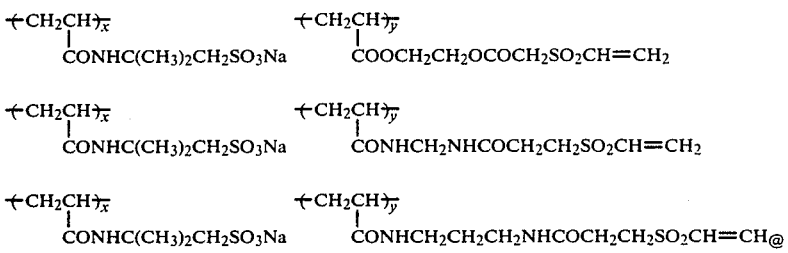

-continued
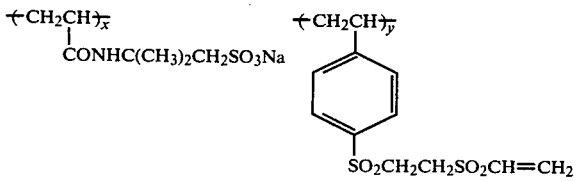
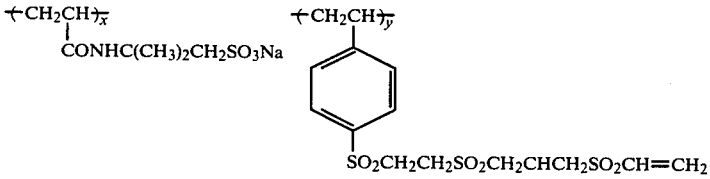
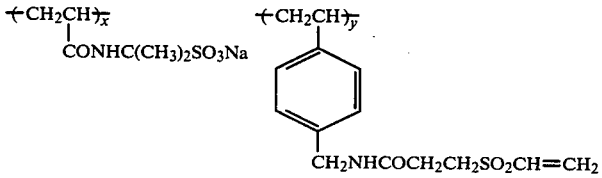
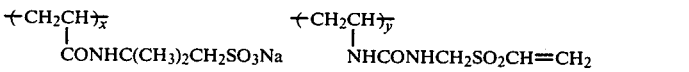
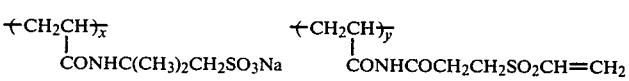
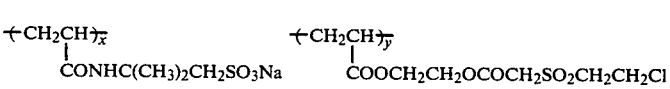
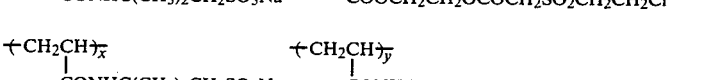
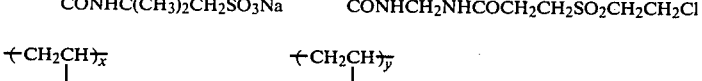
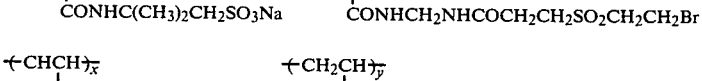
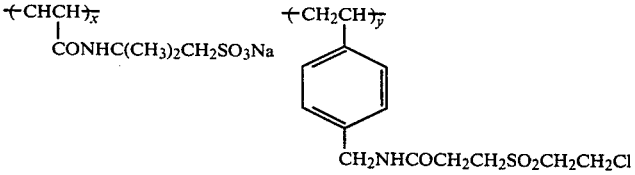
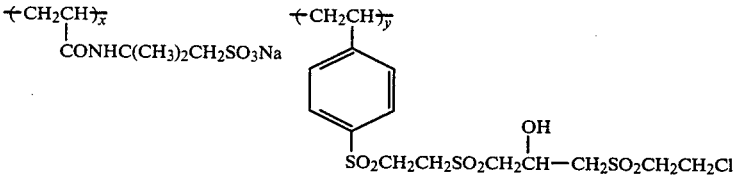
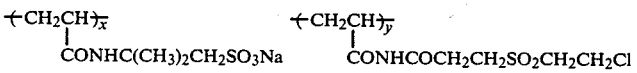
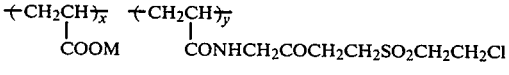
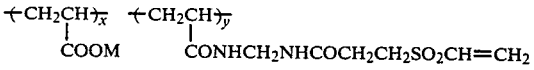

-continued
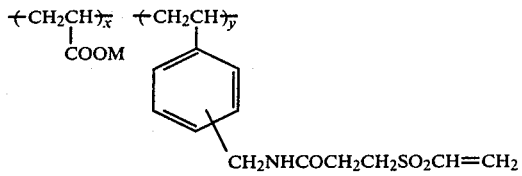
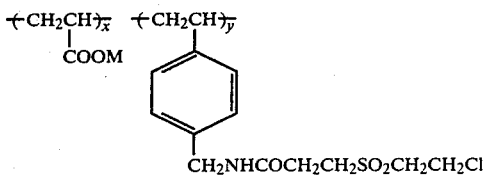
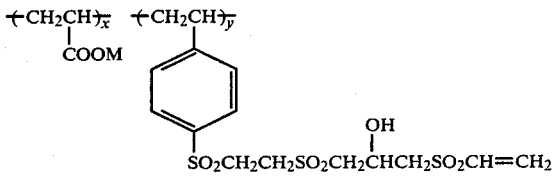
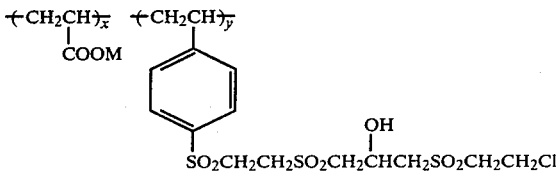
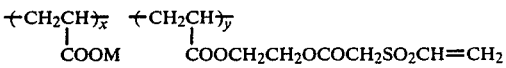
and
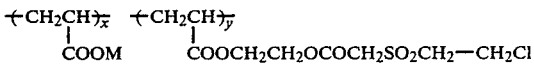
wherein M is a hydrogen atom, a sodium atom or a potassium atom, and x and y represent molar percent x being from 0 to 99, and y being from 1 to 100.
20. The silver halide light-sensitive photographic material as claimed in claim 14, wherein the non-diffusible polymeric hardener has a repeating unit selected from the group consisting of:
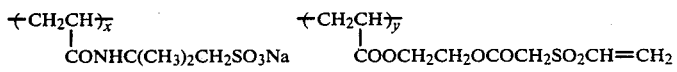
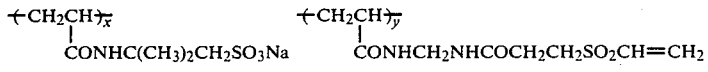
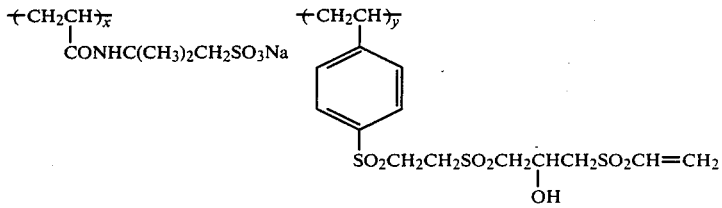

-continued

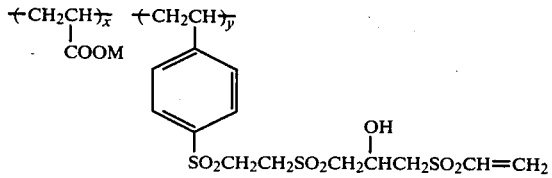

wherein x and y represent molar percent, x being from 0 to 99, and y being from 1 to 100.

21. The silver halide light-sensitive photographic material as claimed in claim 14, wherein the non-diffusible polymeric hardener has a repeating unit selected form the group consisting of:

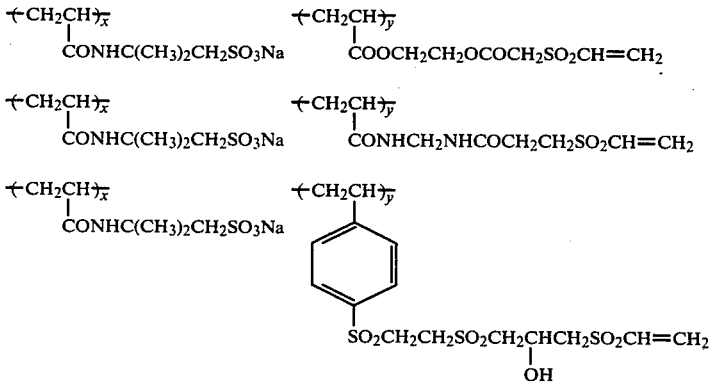

wherein x and y represent molar percent, x being from 0 to 99, and y being from 1 to 100.

22. The silver halide light-sensitive photographic material as claimed in claim 14, wherein the non-diffusible polymeric hardener is a member selected from the group consisting of [2-(3-vinylsulfonyl)propionyloxy]ethyl acrylate/sodium acrylamido-2-methylpropanesulfonate copolymer, 2-[3-(chloroethylsulfonyl)propionyloxy]ethyl acrylate/sodium acrylamido-2-methylpropanesulfonate copolymer, [3-(chloroethylsulfonyl)-propionyl]aminomethylstyrene/sodium acrylamido-2-methylpropanesulfonate copolymer and 1-{[2-(4-vinylbenzenesulfonyl)ethyl]sulfonyl}-3-chloroethylsulfonyl-2-propanol/sodium acrylate copolymer.

23. The silver halide photographic sensitive material as claimed in claim 1, wherein the second insensitive layer is gelatin.

* * * * *